US006059426A

United States Patent [19]

Lavy

[11] Patent Number: 6,059,426

[45] **Date of Patent: *May 9, 2000**

[54] LAMP HEAD INCORPORATED WITH ANTI-COMBUSTION ARRANGEMENT

[76] Inventor: Danny Lavy, 225 Chabanel Street W #500, Montreal, PQ, H2N 2C9, Canada

[ * ] Notice: This patent is subject to a terminal disclaimer.

[21] Appl. No.: 09/182,119

[22] Filed: Oct. 29, 1998

[51] Int. Cl.[7] ..... F21V 29/00; F21V 13/10

[52] U.S. Cl. ..... 362/264; 362/218; 362/223; 362/294; 362/307; 362/343; 362/378; 362/414

[58] Field of Search ..... 362/264, 218, 362/223, 294, 307, 343, 344, 345, 376, 378, 414

[56] References Cited

U.S. PATENT DOCUMENTS 5,720,549 2/1998 Lavy ..... 362/278
5,863,111 1/1999 Turner et al. ..... 362/410

*Primary Examiner*—Jon Henry

*Attorney, Agent, or Firm*—Raymond Y. Chan; David and Raymond

[57] ABSTRACT

A lamp head incorporated with an anti-combustion arrangement, which includes an upwardly directed pan, a reflecting disc disposed internally of the pan, and a holding means for electrically receiving a halogen light source. A shielding lens is mounted on the planar lip for closely covering the halogen light source, wherein a high temperature burning zone is formed above the concave reflecting surface and around the halogen light source. The anti-combustion arrangement includes a protective shelter and a supporting means. The protective shelter, which can be made of transparent glass having a plurality of ventilation holes or a wire frame, has a size adapted to entirely cover the halogen light source. The supporting means is adapted for supporting the protective shelter at a predetermined height right above the halogen light source to cover the high temperature burning zone and to define an air ventilation clearance between the protective shelter and the halogen light source.

34 Claims, 12 Drawing Sheets

LAMP HEAD INCORPORATED WITH ANTI-COMBUSTION ARRANGEMENT

CROSS REFERENCE OF RELATED PATENT

This is a non-provisional application based on the U.S. Pat. No. 5,720,549, filed Nov. 26, 1996 and issued Feb. 24, 1998 to the applicant of the present invention.

BACKGROUND OF THE PRESENT INVENTION

The U.S. Pat. No. 5,720,549 is owned by the applicant of the present invention, which is relates to a lamp head and more particularly to a lamp head incorporated with an anti-combustion arrangement for protecting the halogen bulb mounted thereon from any combustible objects or materials that could accidentally be put or flown on top of the halogen bulb, wherein the anti-combustion arrangement can also allow air to circulate above the halogen bulb so as to avoid heat accumulating and building up above the halogen bulb.

The U.S. Pat. No. 5,720,549 claims an anti-combustion arrangement which comprises a transparent protective shelter and a supporting means, wherein the protective shelter has a size adapted to entirely cover the halogen light source, and the supporting means is disposed on the reflector member for supporting the protective shelter at a predetermined height from the planar lip and right above the halogen light source to cover the high temperature burning zone and to define an air ventilation clearance between the protective shelter and the halogen light source.

Alternative embodiments, which can accomplish the same objects and effects of the above patent, have been developed after the application of the above patent by the same inventor. Although the broadened independent claim 1 of the above patent not only covers the three preferred embodiments disclosed in the above patent but also covers all equivalent alternative modes and modifications, including the alternative embodiments of the present invention, that each comprises protective shelter having a size adapted to entirely cover the halogen light source, and supporting means being disposed on the reflector member for supporting the protective shelter at a predetermined height from the planar lip and right above the halogen light source to cover the high temperature burning zone and to define an air ventilation clearance between the protective shelter and the halogen light source, the applicant submits the present invention to also disclose those alternative embodiments in order to achieve better protection for the invention.

SUMMARY OF THE PRESENT INVENTION

It is an object of the present invention to provide a lamp head incorporated with an anti-combustion arrangement which can allow air circulation and ventilation within the high temperature burning zone of the lamp head and thus the heat generated therearound is reduced to a safe condition.

It is another object of the present invention to provide a lamp head incorporated with an anti-combustion arrangement which can prevent falling insects or any other combustible objects or materials to drop into the high temperature burning zone of the lamp head.

It is another object of the present invention to provide a lamp head incorporated with an anti-combustion arrangement which can provide colored lighting with the regular halogen bulb.

Accordingly, the present invention provides a lamp head incorporated with an anti-combustion arrangement that can highly increase the safety regulation in homes and office buildings. The lamp head comprises an upwardly directed pan, a reflector member disposed internally of the pan having a planar lip and a reflecting concave disc supported by the planar lip. The planar lip includes a holding means for receiving a high voltage halogen light source, which is facing upward, and also for supporting a shielding glass adapted to closely cover the halogen light source. The anti-combustion arrangement comprises a protective shelter, which can be made of glass or plastic with holes or metal wire netting, having a size at least equal to the diameter of the reflecting concave disc, and a supporting means for supporting the protective shelter above the halogen light source for a predetermined height. The supporting means comprises at least a supporter having a base member adapted to firmly secure to the reflector member and an upper holder for rigidly and firmly hold the protective shelter right above the reflecting concave disc, the halogen light source and the shielding glass so as to entirely cover a high temperature burning zone which is an area zone above the reflecting concave disc of the reflector member and around the halogen light source. Furthermore, an air ventilation clearance is defined between the protective shelter and the halogen light source shielded with the shielding glass. The temperature within the high temperature burning zone is decreased by spreading the heat wave and providing air ventilation and circulation through the air ventilation clearance. Besides, the protective shelter can prohibit the intrusion of any combustible matters from entering the high temperature burning zone of the lamp head.

DETAILED DESCRIPTION OF THE PREFERRED EMBODIMENTS

Figure 1:
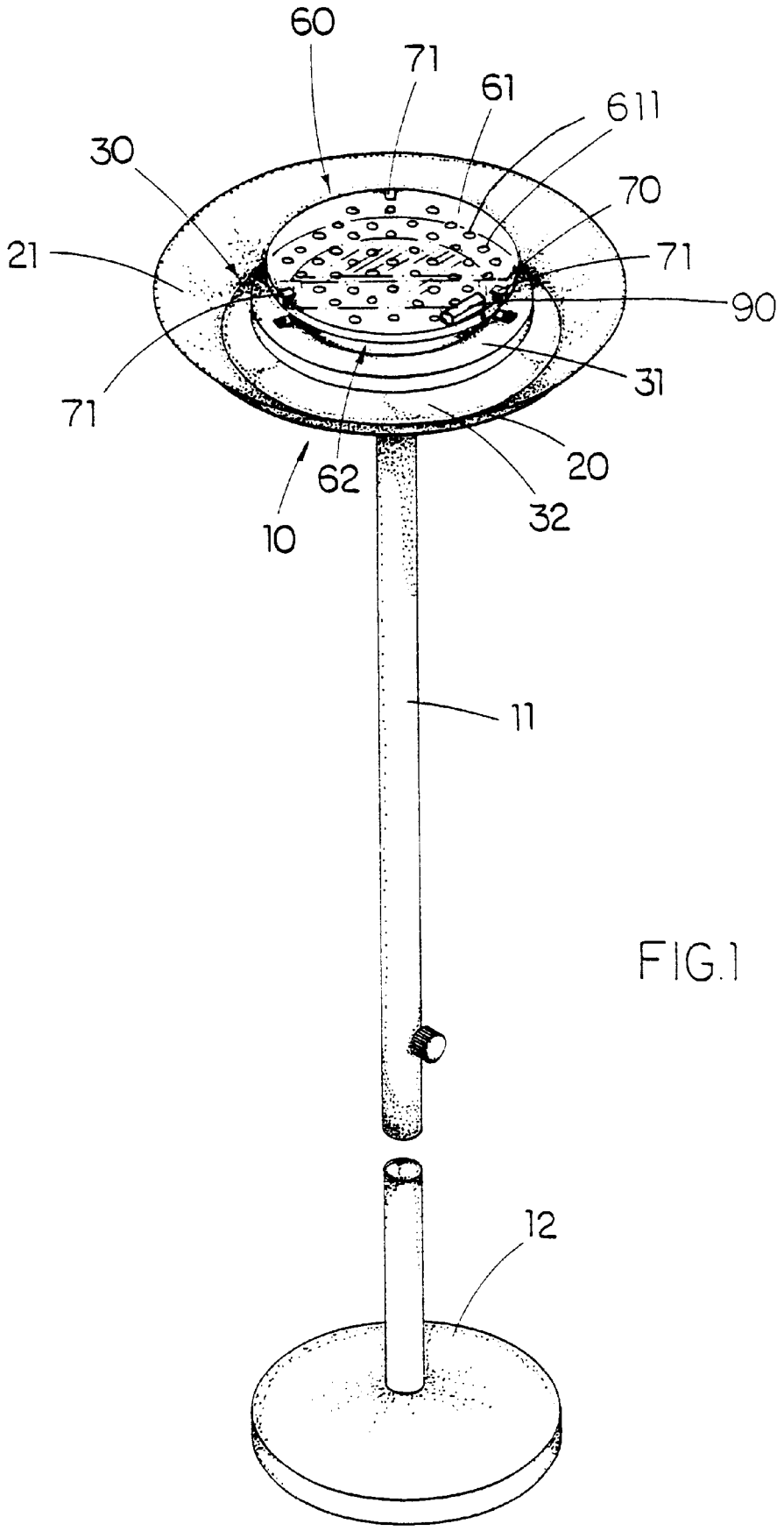
FIG. 1 is a perspective view of a lamp head incorporated with an anti-combustion arrangement according to a first preferred embodiment of the present invention.
Figure 2:
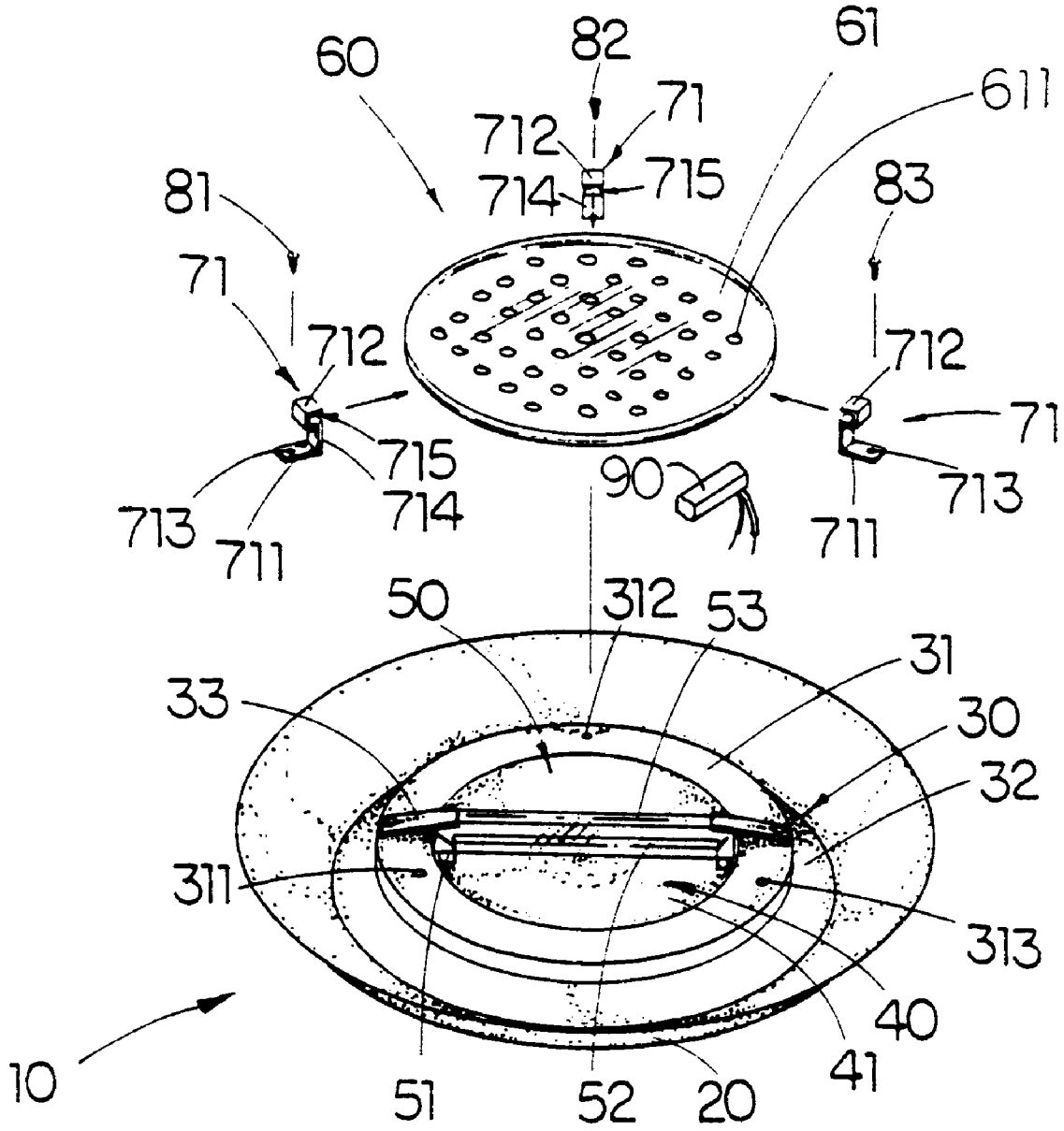
FIG. 2 is an exploded perspective view of the lamp head according to the above first embodiment of present invention.
Figure 3A:
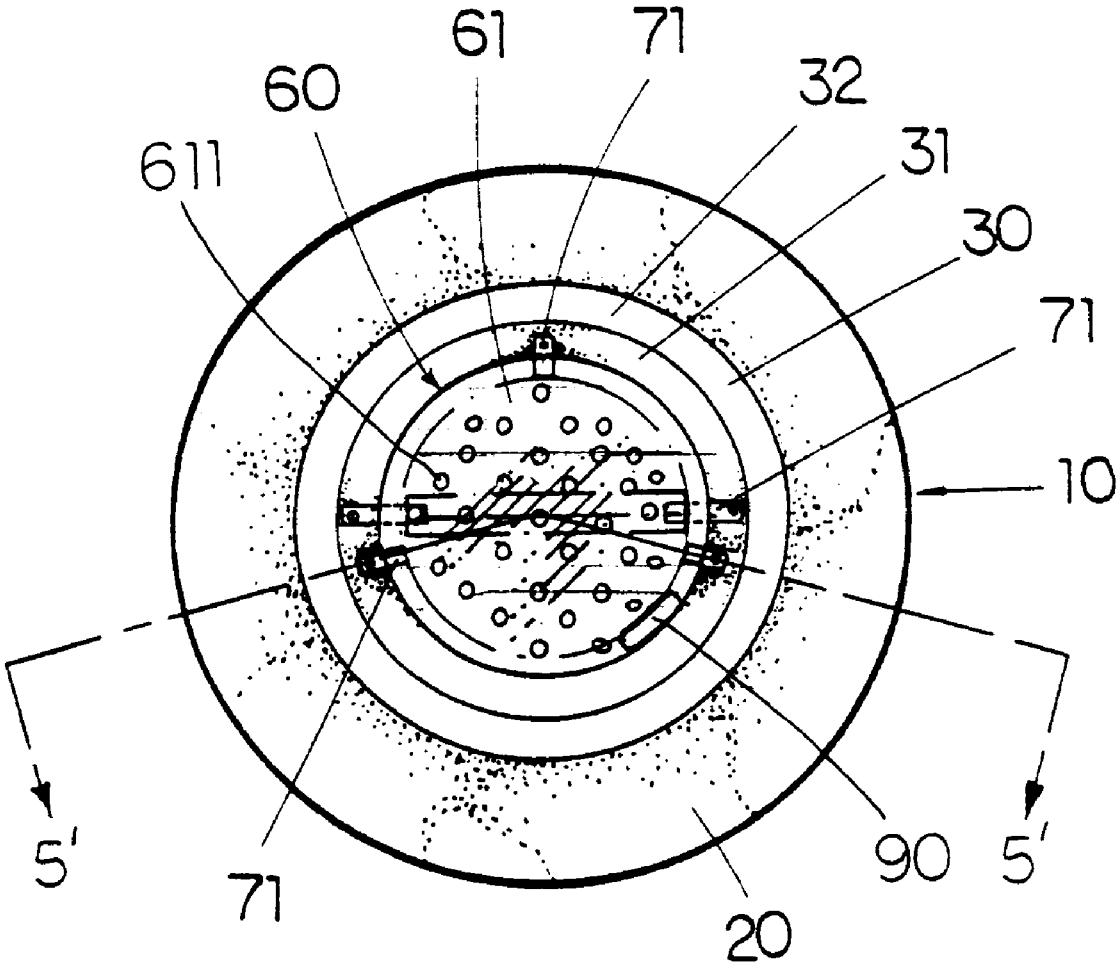
FIG. 3A is a plan view of the lamp head according to the above first embodiment of the present invention.
Figure 3B:
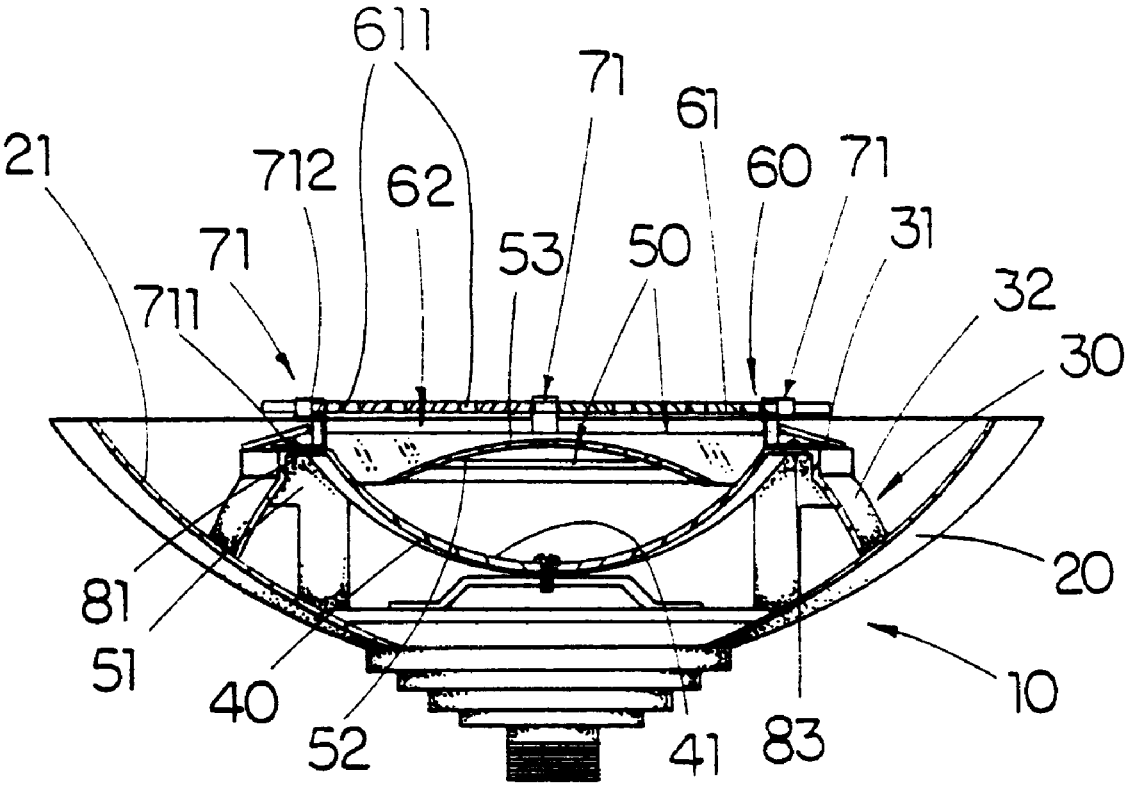
FIG. 3B is a partial sectional end view of the lamp head along the section line A–A' in FIG. 3A according to the above first embodiment of the present invention, showing how the air current within the high temperature zone flows and ventilates.

Referring to FIGS. 1 to 3, a lamp head incorporated with an anti-combustion arrangement according to a first preferred embodiment of the present invention is illustrated. The lamp head 10 generally comprises an upwardly directed dome, bowl or pan 20 and a circular reflector member 30 disposed internally of the pan 20. The reflector member 30 comprises a circular planar lip 31 and a circular supporting wall 32 extended downwardly to integrally affix on an inner surface 21 of the pan 20.

As shown in FIGS. 2 and 3, the lamp head 10 further comprises a concave reflecting disc 40 supported by the planar lip 31 of the reflector member 30. The planar lip 31 includes a holding means 51 for electrically receiving a high voltage halogen light source 52 or other light source that would generate heat. The high voltage halogen light source 52 is a halogen bulb facing upward according to the present embodiment The reflecting disc 40 has an inner concave reflecting surface 41 for reflecting the light beams emitted from the halogen light source 52 upwardly. The planar lip 31 further provides a pair of holding joints 33 for supporting an arc-shaped shielding lens 53 which is adapted to closely cover the halogen light source 52.

Generally, the common lamp head 10 as described above is affixed to a top end of a stem 11 which is rigidly affixed to a weighty base 12, as shown in FIG. 3, to assemble as a stand-alone electric lamp. The stand-alone electric lamp can be a floor lamp when an elongated stem 11 is used to rise the lamp head 10 up vertically above and over our head level. The stand-alone electric lamp will be a table lamp if a short stem is used.

It is well known that the halogen light source 52 of such lamp head 10 of the standalone electric lamp generates a great amount of heat so that the cavity defined between the concave reflecting surface 41 of the reflecting disc 40 and the halogen light source 52 has a relatively high temperature. The halogen light source 52 and the concave reflecting surface 41 become burning hot. Therefore, a high temperature burning zone 50 is formed, as shown in FIG. 2, which includes the space above the concave reflecting surface 41 and around the halogen light source 52. In fact, it is a hazardous situation that, if insects or any other combustible objects is placed or fallen on this high temperature burning zone accidentally, such combustible objects will be burnt by the heat of the high temperature burning zone 50 and may cause hazardous fire.

In order to prevent heat builds up in the high temperature burning zone 50, the lamp head 10 of the present invention is incorporated with an anti-combustion arrangement 60. The anti-combustion arrangement 60 comprises a protective shelter 61 having a size at least equal to the length of the halogen light source 52 and a supporting means 70 for supporting the protective shelter 61 at a predetermined height right above the halogen light source 52 to define an air ventilation clearance 62 between the protective shelter 61 and the halogen light source 52.

In accordance with the first embodiment of the present invention, the protective shelter 61 is made of a thickened heat-resistant circular planar transparent glass having a diameter equal to or larger than the length of the halogen light source 52 or the diameter of the reflecting disc 40 in order to cover both the halogen light source 52 and the reflecting disc 40. A plurality of ventilation holes 611 are spacedly provided on the protective shelter 61 to enhance the air ventilation between the protective shelter 61 and the halogen light source 52, wherein cooler air on top of the protection shelter 61 can also enter the air ventilation clearance 62 through the ventilation holes 61 1.

The supporting means 70 comprises at least a supporter 71 for rigidly and firmly holding the protective shelter 61 right above the concave reflecting disc 52, the halogen light source 40 and the shielding lens 53 so as to entirely cover the high temperature burning zone 50. According to the first preferred embodiment, there are three supporters 71 firmly secured to the reflector member 30 respectively.

According to the first embodiment, there are three identical S-shaped supporters 71 affixed angularly and spacedly on the planar lip 31 of the reflector member 30 to evenly hold and support the protective shelter 61 in position. Each supporter 71 has a base member 711 and a holder member 712. The planar lip 31 has three screw holes 311, 312, 313 formed angularly and spacedly thereon. The three base members 711, each having a connecting hole 713, are firmly screwed onto the three screw holes 311, 312, 313 of the planar lip 31 of the reflector member 30 by three screws 81, 82, 83 (as shown in FIG. 2) through the three connecting holes 713. Each base member 711 further has a vertical neck 714 extending upwardly from the base member 711 for a predetermined height to integrally connect with the respective holder member 712. Each holder member 712 is in C-shaped and defines a receiving slot 715 facing to the center of the concave reflecting surface 41 of the reflecting disc 40 for engaging with a periphery edge of the protective shelter 61. Therefore, by screwing the three supporters 71 onto the planar lip 31 of the reflector member 30, the protective shelter can thus be supported on top of the halogen light source 52 and the reflecting disc 40. The upwardly extending necks 714 of the three supporters 71 raise the protective shelter 61, which is firmly held by the three holder members 712 in position, for a predetermined height from the planar lip 31 to define the air ventilation clearance 62 between the protective shelter 61 and the shielding lens 53 of the halogen light source 52.

To replace a new halogen light source 52, the user simply needs to unscrew one of the three screws 81, 82, 83 and removes one of the supporters 71. Then, the user may easily slide the protective shelter 61 out of the two receiving slots 715 of the other two affixed supporters 71. After the halogen bulb replacement, the user can slide back the protective shelter 61 to the two receiving slots 715 of the two affixed supporters 71, and then mount the holder member 712 of the detached supporters 71 on the protective shelter 61 again, and then re-screw the detached supporters 71 onto the planar lip 31.

As shown in FIG. 3, since the protective shelter 61 is installed to overlap and cover the whole high temperature burning zone near the halogen light source 52 and the concave reflecting surface 41 of the lamp head 10, the high temperature burning zone 50 is sheltered by the protective shelter 61 to prohibit the intrusion of any object from entering the high temperature burning zone 50 of the lamp head 10. Moreover, the protective shelter 61 guides and spreads the heat wave generated by the halogen light source 52 to flow aside, the temperature within the high temperature burning zone 50 is decreased by spreading the heat wave and providing air ventilation and circulation through the air ventilation clearance 62. Also, due to the heat insulation effect provided by the thickened glass protective shelter 61, the temperature of the top surface of the protective shelter 61 is greatly reduced to a noncombustible temperature. Another unexpected result can also be achieved by the anti-combustion arrangement 60 of the present invention. Generally, the conventional halogen bulb merely provides white light. However, according to the present invention, since the protective shelter 61 is installed to entirely overlap and cover the halogen light source 52, a colored transparent glass can be used as the protective shelter 61 so that the lighting of the halogen light source 52 can thus be filtered to colored lighting. The user may replace different protective shelters 61 of different colors to achieve different colored lighting whenever the user desires.

As shown in FIG. 1, a heat sensor 90 which is shown in phantom line can be selectively mounted on top or below the protective shelter 61, wherein the heat sensor 90 is electrically connected to the electric circuit of the lamp head 10. As mentioned above, the high temperature burning zone 50 is sheltered by the protective shelter 61 to prohibit the intrusion of any object from entering the high temperature burning zone 50 of the lamp head 10, so that if there is any object fallen to the lamp head 10, such object will be stopped by the protective shelter 61. The heat sensor 90 is adapted to detect the temperature around the protective shelter 61, so that if the temperature around the protection shelter 61 increases to a predetermined value that may cause the fallen object to burn, the heat sensor 90 will send signal to turn off the halogen light source 52 of the lamp head 10.

Figure 4:
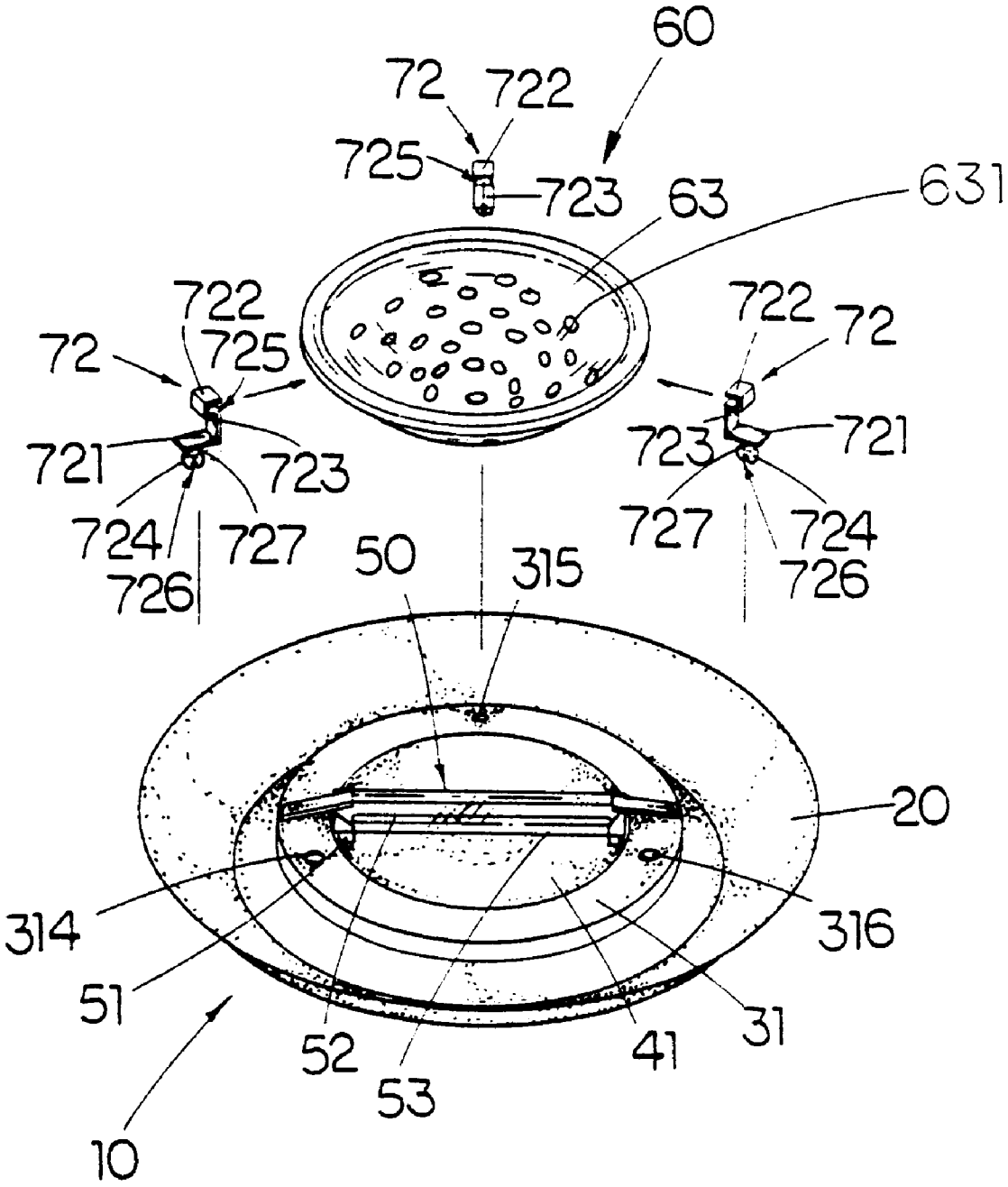
FIG. 4 is an exploded perspective view of a lamp head incorporated with an anti-combustion arrangement according to a second preferred embodiment of the present invention.
Figure 5:
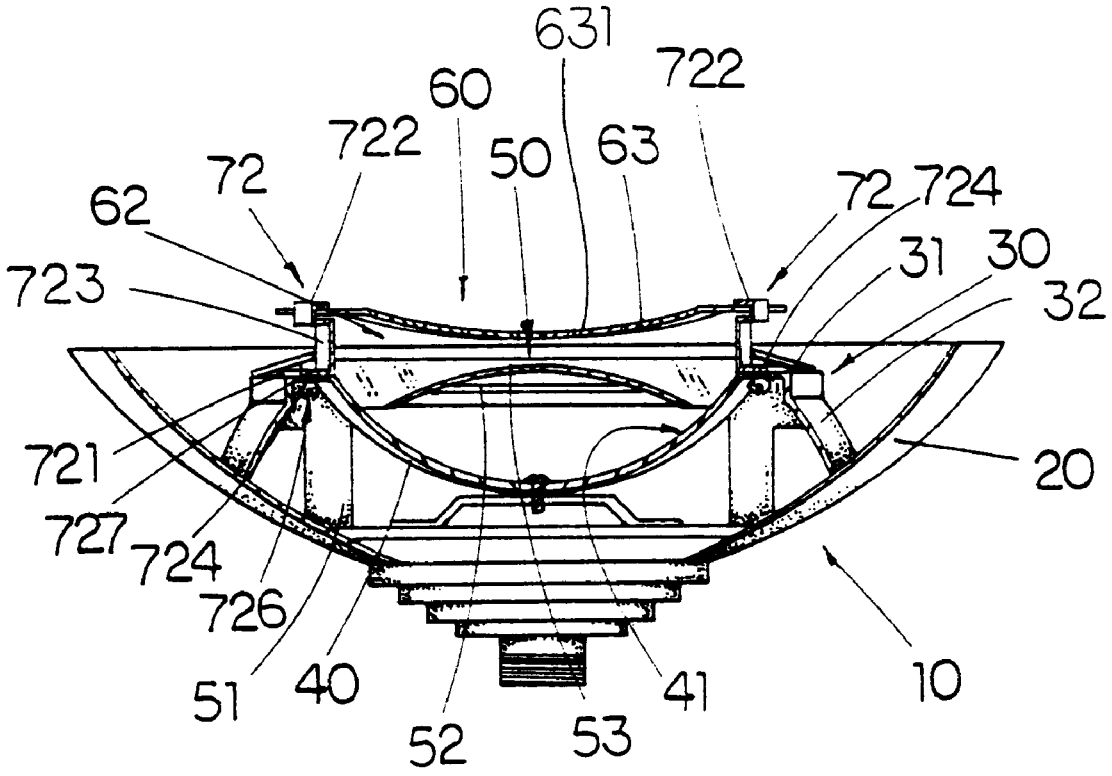
FIG. 5 is a partial sectional end view of the lamp head according to the above second preferred embodiment of the present invention, illustrating the detachably mounting of the supporters for holding a concave protective shelter.

Referring to FIGS. 4 and 5, a second preferred embodiment of the present invention is illustrated, in which a second embodied anti-combustion arrangement 60 including an alternative mode of the protective shelter 63 and a modification of the three supporters 72 is utilized in the lamp head 10 as disclosed in the above first embodiment.

The protective shelter 63 in this second embodiment is made of a thickened transparent concave glass which also has a diameter successfully covering and protecting the high temperature burning zone 50 from the intrusion of any combustible matters. A plurality of ventilation holes 631 are also spacedly provided on the protective shelter 63 to enhance the air ventilation between the protective shelter 63 and the halogen light source 52, wherein cooler air on top of the protection shelter 63 can also enter the air ventilation clearance 62 through the ventilation holes 631.

Each of the supporters 72 comprises a base member 721, a C-shaped holder member 722 and a vertical neck 723 extending from the base member 721 upwardly to connect with the holder member 722 so as to raise the holder member 722 for a predetermined height. The planar lip 31 of the reflector member 30 has three securing holes 314, 315, 316.

The base member 721 of each supporter 72 has a connecting stem 727 extended downwardly to integrally connect with an enlarged holding head 724 which is adapted for inserting through the respective securing hole 314, 315, 316 of the planar lip 31. Therefore, the three supporters 72 can be rotatably, angularly and spacedly held on the planar lip 31. Each holder member 722 forms a receiving slot 725, having a width equal to the thickness of the protective shelter 63, for receiving a periphery edge of the protective shelter 63. Therefore, the protective shelter 63 can be firmly supported right above the concave reflecting surface 41, the halogen light source 52 and the shielding lens 53 by the three supporters 72. Accordingly, the high temperature burning zone 50 is overlapped and covered by the protective shelter 63, wherein the air ventilation clearance 62 is also defined between the concave protective shelter 63 and the shielding lens 53 for heat wave spreading. Furthermore, each of the holding heads 724 has a compressive slot 726 formed thereon for facilitating the insertion of the holding heads 724 through the securing holes 314, 315, 316 and enabling the holding heads 724 to be directly pulled out through the securing holes 314, 315, 316 for replacing the halogen light source 52 or the protective shelter 63 of different color. The user may also detach the concave protective shelter 63 from the lamp head 10 by turning the holder members 722 for 180 degree.

Figure 6:
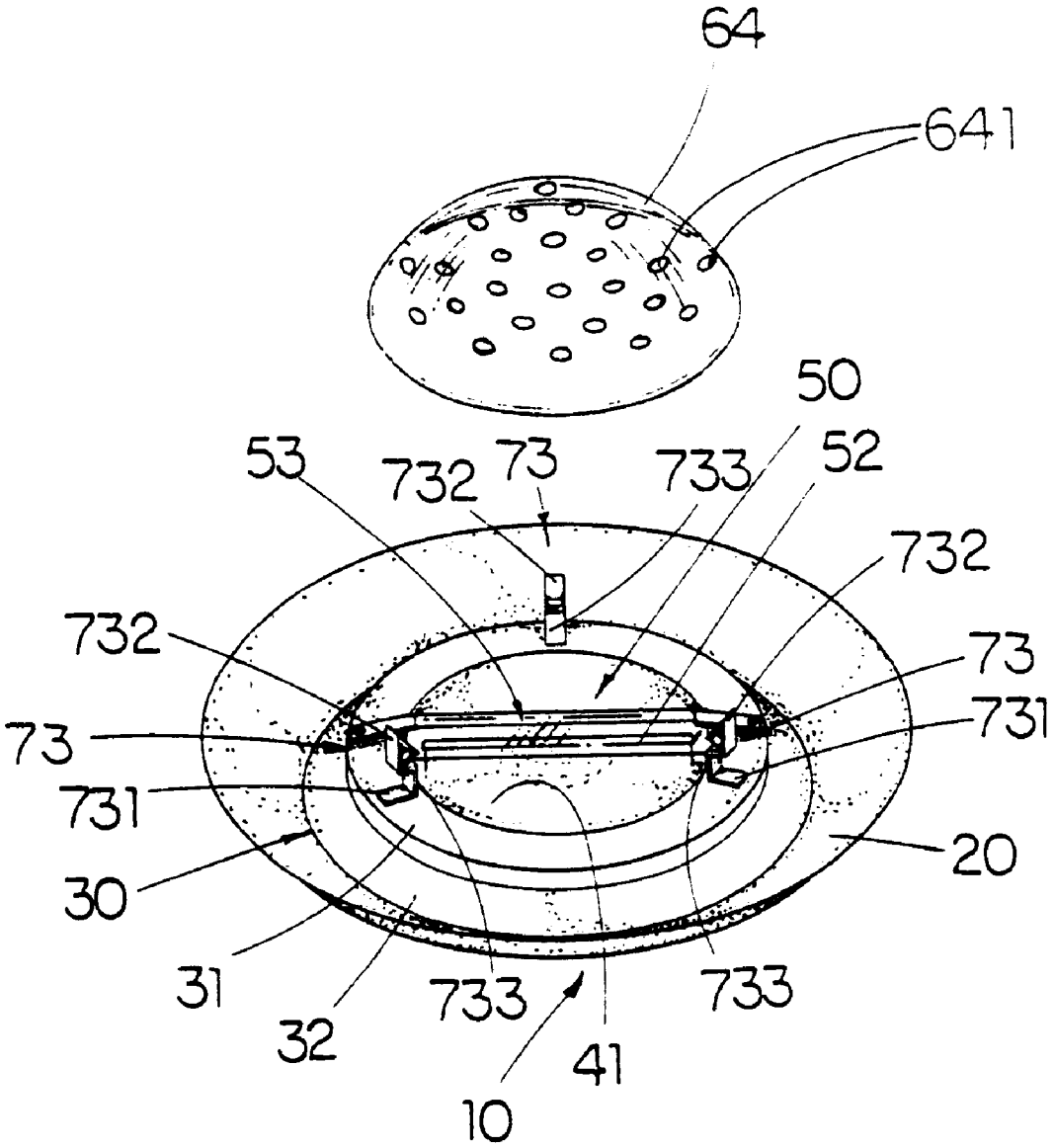
FIG. 6 is an exploded perspective view of a lamp head incorporated with an anti-combustion arrangement according to a third preferred embodiment of the present invention.
Figure 7:
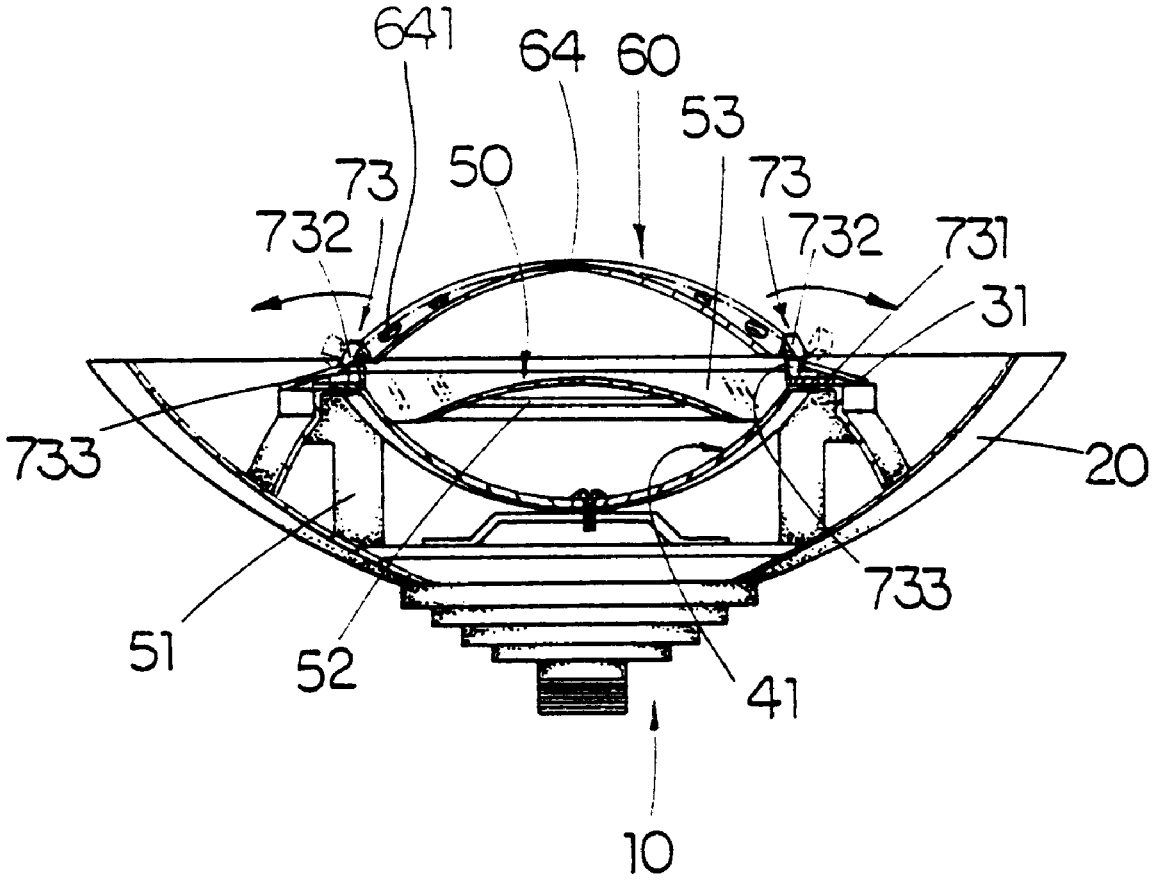
FIG. 7 is a partial sectional end view of the lamp head according to the above third preferred embodiment of the present invention, illustrating the welded mounting of the supporters for holding a convex protective shelter.

Referring to FIGS. 6 and 7, a third preferred embodiment of the present invention is illustrated, which is an alternative mode of the above second embodiment In accordance to the third preferred embodiment of the present invention, the protective shelter 64 is a thickened transparent convex glass mounted to protect the high temperature burning zone 50. Also, a plurality of ventilation holes 641 are spacedly provided on the protective shelter 64 to enhance the air ventilation between the protective shelter 64 and the halogen light source 52, wherein cooler air on top of the protection shelter 64 can also enter the air ventilation clearance 62 through the ventilation holes 641.

Each of the supporters 73 comprises a base member 731, a clamp-like holder member 732 and a vertical neck 733 extending from the base member 731 upwardly to connect with the holder member 732 so as to raise the holder member 732 for a predetermined height The three base members 731 are firmly welded on the planar lip 31 of the reflector member 30. The three clamp-like holder members 732 are clipped on the periphery edge of the convex protective shelter 64 so as to support the convex protective shelter 64 right above the high temperature burning zone 50. When the user would like to replace the halogen light source 52 or another protective shelter 64 of different color or shape, the user can simply push the holder members 732 outwardly (illustrating by the dotted-line in FIG. 7) for detaching the protective shelter 64 from the lamp head 10.

It is worth to mentioned that both the above second and third preferred embodiments of the present invention can also respectively installed a heat sensor as mentioned in the first embodiment to the protective shelter 63 or 64 for ensuring the temperature around the protective shelter 63, 64 would not exceed a predetermined safety temperature.

Figure 8:
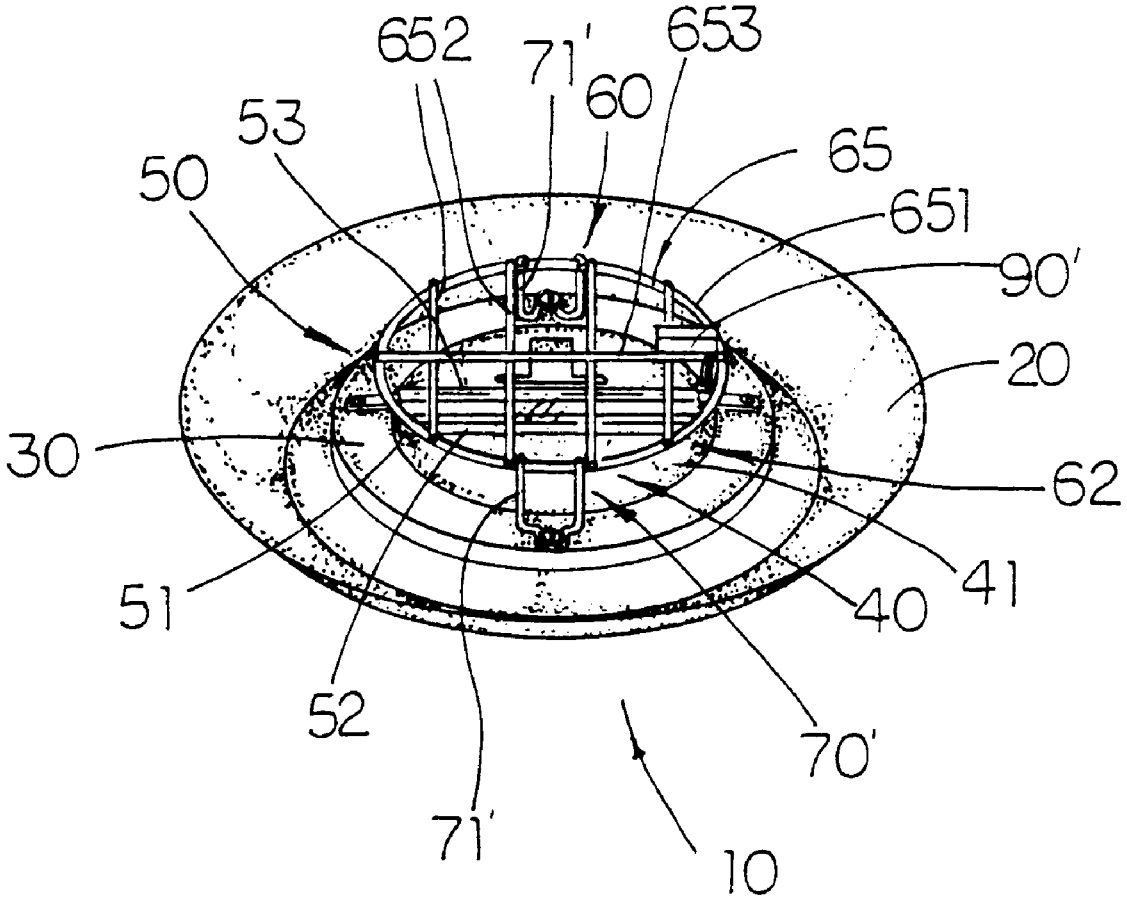
FIG. 8 is a perspective view of a lamp head according to a fourth preferred embodiment of the present invention.
Figure 9:
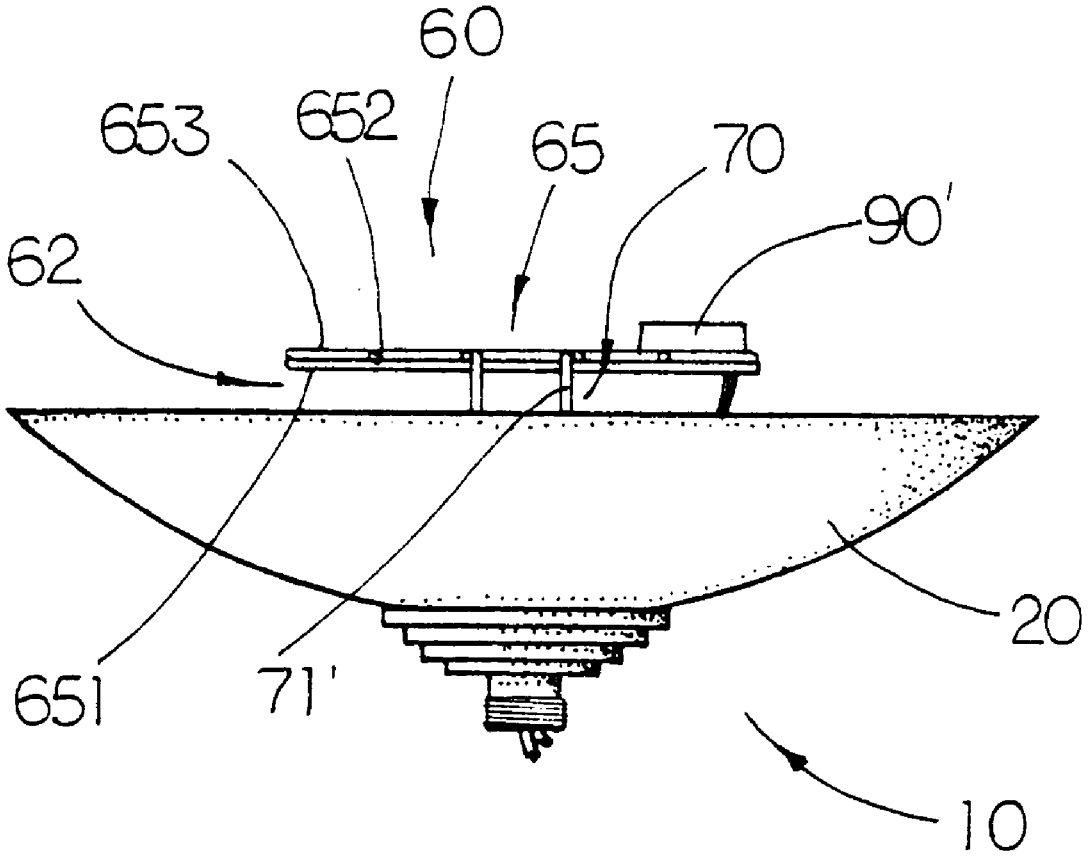
FIG. 9 is a side view of the lamp head according to the above fourth preferred embodiment of the present invention.

Referring to FIGS. 8 and 9, a lamp head 10 according to a fourth preferred embodiment of the present invention is illustrated, wherein the lamp head 10 which has an identical structure of the above embodiments also comprises an upwardly directed pan 20, a reflecting disc 40 disposed internally of the pan 20, and a holding means 51 for electrically receiving a halogen light source 52. The reflecting disc 40 has an reflecting surface 41 positioning below the halogen light source 52 for reflecting the light beams emitted from the halogen light source 52 upwardly. A shielding lens 53 is mounted on top of the halogen light source 52 for closely covering the halogen light source 52. A temperature burning zone 50 is formed above the reflecting surface 41 and around the halogen light source 52.

The lamp head 10 according to the fourth preferred embodiment also comprises an anti-combustion arrangement 60, which comprises a protective shelter 65 and a supporting means 70'. The protective shelter 65 is a metal made wire frame substituting the glass made protective shelter 61, 63 or 64 of the above three embodiments. The wire frame protective shelter 65, according to the fourth preferred embodiment, is made of a plurality of metal wires arranged in crisscross manner, including a circular wire frame 651 and a plurality of supporting wires 652 extending between two sides of the circular wire frame 651. The wire frame protective shelter 65 may further comprises at least a reinforcing wire 653 extending across the plurality of supporting wires 652 to reinforce the supporting wires 652. The supporting means 70' is adapted for supporting said protective shelter 65 at a predetermined height from shielding lens 53 and right above the halogen light source 52 to cover the high temperature burning zone 50 and to define an air ventilation clearance 62 between the protective shelter 65 and the halogen light source 52.

Although the wire frame protective shelter 65, in comparison with the glass made protective shelter 61, 63 or 64 of the above first, second and third preferred embodiments, can not guide and spread the heat wave generated by the halogen light source 52 to flow aside. Moreover, the wire frame protective shelter 65 also can not filter colored lighting. However, the wire frame protective shelter 65 can still enable the light beams emitted from the halogen light source 52 to pass through to achieve the equivalent transparent effect of the glass made protective shelter 61, 63 or 64. Besides, although the wire frame protective shelter 65 may project wire shading on the ceiling while the glass made protective shelter 65 would not, the wire frame protective shelter 65 is also installed to overlap and cover the whole high temperature burning zone 50 near the halogen light source 52 of the lamp head 10. In other words, the high temperature burning zone 50 is sheltered by the wire frame protective shelter 65 to prohibit the intrusion of object like fabric and clothes from entering the high temperature burning zone 50 of the lamp head 10.

It is worth to mention that, since the wire frame protective shelter 65 fails to provide a heat insulation effect as provided by the thickened glass protective shelter 61, 63 or 64, the temperature of the top surface of the wire frame protective shelter 65 may not be reduced to a non-combustible temperature. However, a heat sensor 90', which is electrically connected to the electric circuit of the lamp head 10, can be installed on or below the wire frame protective shelter 65 for detecting a temperature around the protective shelter 65. When the temperature around the wire frame protective shelter 65 is detected exceeding a predetermined temperature, the heat sensor 90' will send a signal to turn off the halogen light source 52 of the lamp head 10, so as to regulate the temperature around the wire frame protective shelter 65 below a preset safety temperature. In other words, even though there is a fabric object fallen on the wire frame protective shelter 65, the heat sensor 90' which is set to react below the combustion temperature of fabric or clothes will turn off the halogen light source 52 to cease heat generating before the fabric object starting to combust.

The supporting means 70' can be the supporters 71 as disclosed in the above embodiments or other types of supporter adapted to secured to the pan 20 or the holding means 51 for supporting the halogen light source 52 and the shielding lens 53. According to the fourth preferred embodiment of the present invention, the supporting means 70' comprises at least two supporters 71' downwardly extended from two facing sides the circular wire frame 651 for supporting the wire frame protective shelter 65 at a predetermined height from the halogen light source 52 to cover the high temperature burning zone 50 and to define the air ventilation clearance 62 between the protective shelter 65 and the halogen light source 52. Each of the supporters 71' comprises a U-shaped wire stand having a bottom end adapted to secure by screwing on a reflector member 30 adapted for supporting the reflecting disc 40 in position.

Figure 10:
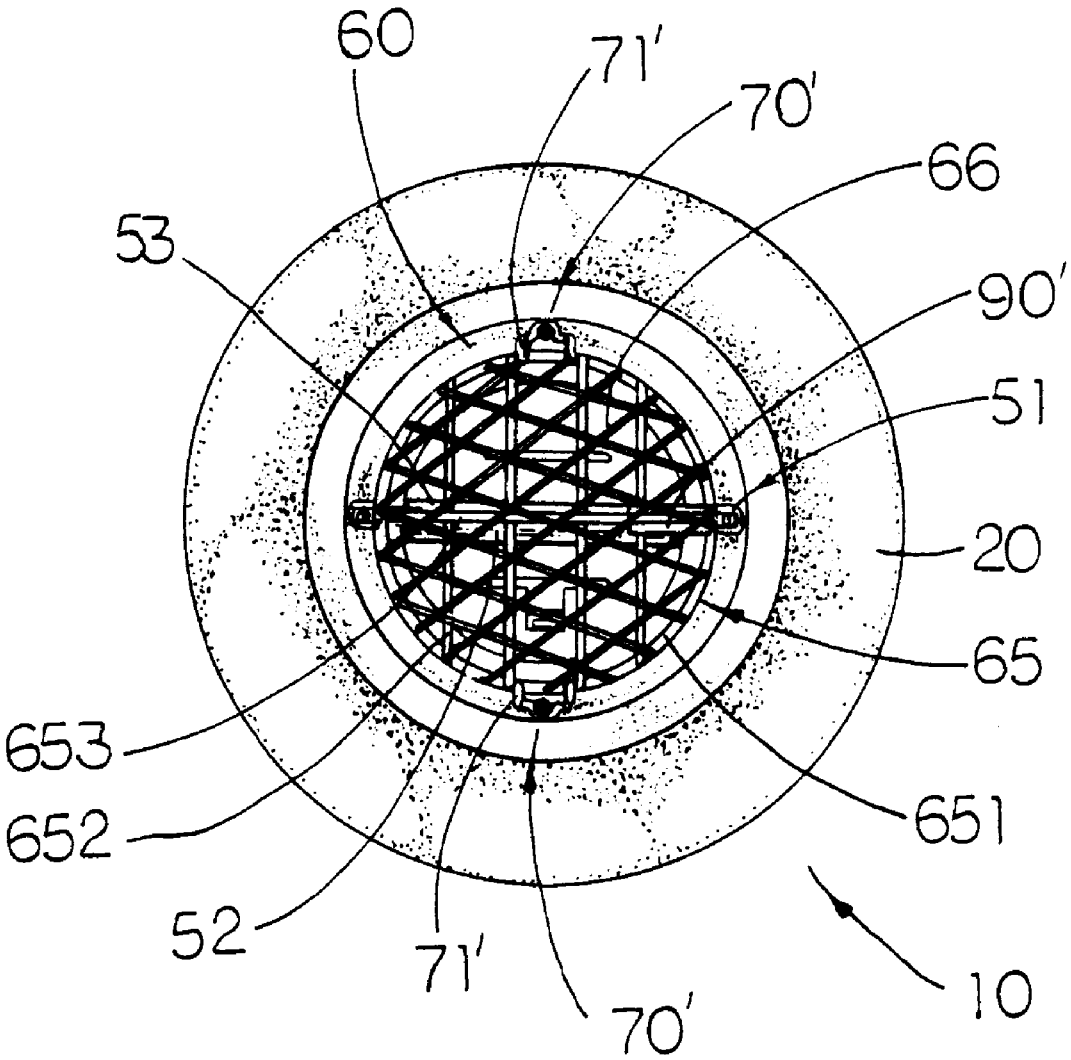
FIG. 10 is a top view of a lamp head according to a fifth preferred embodiment of the present invention.
Figure 11:
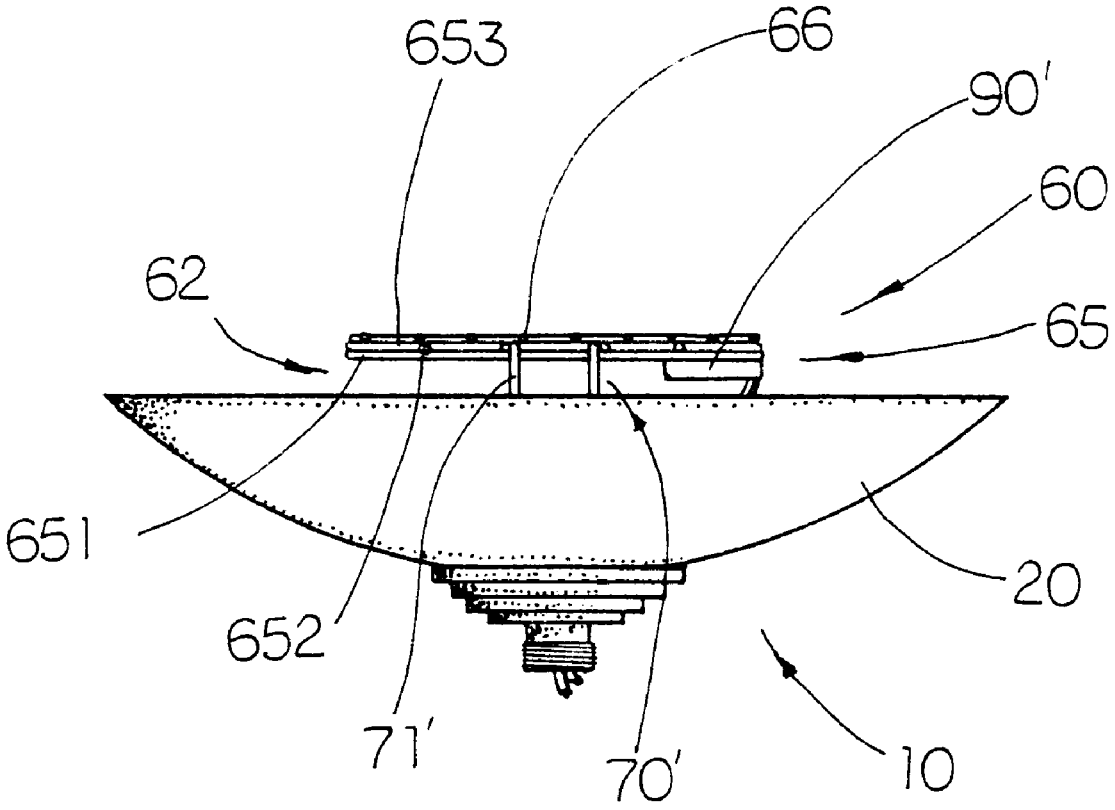
FIG. 11 is a side view of the lamp head according to the above fifth preferred embodiment of the present invention.

Referring to FIGS. 10 and 11, a lamp head 10 according to a fifth preferred embodiment of the present invention is illustrated, which is basically identical to the above fourth preferred embodiment. The different between the fifth embodiment and the fourth embodiment is that the anti-combustion arrangement 60 of the fifth embodiment further comprises a wire netting gauze 66 having a size at least equal to the size of the wire frame protective shelter 65. The wire netting gauze 66 is disposed or attached on top or below the wire frame protective shelter 65 so as to reduce the size of the mesh holes of the protective shelter 65 for stopping smaller objects to enter the high temperature burning zone 50. Of course, the wire frame protective shelter 65 itself can also be made to such netting gauze form with smaller mesh holes so that no additional wire netting gauze 66 is required.

What is claimed is:

1. A lamp head, comprising an upwardly directed pan;

a holding means for electrically receiving a halogen light source;

a reflecting disc disposed internally of said pan, said reflecting disc having an reflecting surface positioned below said halogen light source;

a shielding lens mounted on top of said halogen light source for closely covering said halogen light source, wherein a high temperature burning zone is formed above said reflecting surface and around said halogen light source; and an anti-combustion arrangement which comprises a protective shelter made of transparent material, said protective shelter having a size adapted to entirely cover said halogen light source and a plurality of air ventilation holes spacedly provided on said protective shelter, said anti-combustion arrangement further comprising a supporting means for supporting said protective shelter at a predetermined height from said shielding lens and right above said halogen light source to cover said high temperature burning zone and to define an air ventilation clearance between said protective shelter and said halogen light source.

2. A lamp head as recited in claim 1 wherein said supporting means comprises at least two supporters respectively firmly secured on a reflector member adapted for supporting said reflecting disc in position for rigidly and firmly holding said protective shelter right above said reflecting disc, said halogen light source and said shielding lens so as to entirely cover said high temperature burning zone.

3. A lamp head as recited in claim 2 wherein each of said supporters has a base member for secured on said reflector member and a holder member for firmly holding and supporting said protective shelter in position.

4. A lamp head as recited in claim 3 in which each of said supporters further comprises a vertical neck extending from said base member upwardly to connect with said holder member so as to raise said holder member for a predetermined height, said reflector member having at least two securing holes, said base member of each of said supporters having a connecting stem extended downwardly to integrally connect with an enlarged holding head which is adapted for inserting through said respective securing hole of said reflector member, so that said supporters are rotatably, angularly and spacedly held on said reflector member, each of said holder members forming a receiving slot, having a width at least equal to a thickness of said protective shelter, for receiving a periphery edge of said protective shelter, so as to support said protective shelter right above reflecting surface, said halogen light source and said shielding lens for overlapping and covering said high temperature burning zone.

5. A lamp head as recited in claim 4 wherein each of said holding heads has a compressive slot formed thereon for facilitating the insertion of said holding heads through said securing holes and enabling said holding heads to be pulled out through said securing holes for replacing said halogen light source.

6. A lamp head as recited in claim 1 wherein said protective shelter is made of a thickened heat-resistant circular transparent planar glass having a diameter at least equal to said length of said halogen light source.

7. A lamp head as recited in claim 3 wherein said protective shelter is made of a thickened heat-resistant circular transparent planar glass having a diameter at least equal to said length of said halogen light source.

8. A lamp head as recited in claim 5 wherein said protective shelter is made of a thickened heat-resistant circular transparent planar glass having a diameter at least equal to said length of said halogen light source.

9. A lamp head as recited in claim 1 wherein said protective shelter is made of a thickened transparent curved glass.

10. A lamp head as recited in claim 3 wherein said protective shelter is made of a thickened transparent curved glass.

11. A lamp head as recited in claim 5 wherein said protective shelter is made of a thickened transparent curved glass.

12. A lamp head as recited in claim 1 wherein said protective shelter is a colored transparent protective shelter.

13. A lamp head as recited in claim 1 further comprising a heat sensor mounted on said protective shelter to detect the temperature around said protective shelter and to turn off said halogen light source when the temperature around said protective shelter exceeds a predetermined temperature.

14. A lamp head as recited in claim 3 further comprising a heat sensor mounted on said protective shelter to detect the temperature around said protective shelter and to turn off said halogen light source when the temperature around said protective shelter exceeds a predetermined temperature.

15. A lamp head as recited in claim 7 further comprising a heat sensor mounted on said protective shelter to detect the temperature around said protective shelter and to turn off said halogen light source when the temperature around said protective shelter exceeds a predetermined temperature.

16. A lamp head as recited in claim 10 further comprising a heat sensor mounted on said protective shelter to detect the temperature around said protective shelter and to turn off said halogen light source when the temperature around said protective shelter exceeds a predetermined temperature.

17. A lamp head, comprising an upwardly directed pan;

a holding means for electrically receiving a halogen light source;

a reflecting disc disposed internally of said pan, said reflecting disc having an reflecting surface positioned below said halogen light source;

a shielding lens mounted on top of said halogen light source for closely covering said halogen light source, wherein a high temperature burning zone is formed above said reflecting surface and around said halogen light source; and an anti-combustion arrangement comprising a protective shelter which is a wire frame having a size adapted to entirely cover said halogen light source and a plurality of air ventilation holes spacedly provided on said protective shelter, said anti-combustion arrangement further comprising a supporting means for supporting said protective shelter at a predetermined height from said shielding lens and right above said halogen light source to cover said high temperature burning zone and to define an air ventilation clearance between said protective shelter and said halogen light source.

18. A lamp head as recited in claim 17 wherein said protective shelter is made of a plurality of metal wires arranged in crisscross manner.

19. A lamp head as recited in claim 18 wherein said protective shelter includes a circular wire frame and a plurality of supporting wires extending two sides of said circular wire frame.

20. A lamp head as recited in claim 19 wherein said protective shelter further comprises at least a reinforcing wire extending across said plurality of supporting wires to reinforce said supporting wires.

21. A lamp head as recited in claim 18 further comprising a wire netting gauze attached to said protective shelter.

22. A lamp head as recited in claim 19 further comprising a wire netting gauze attached to said protective shelter.

23. A lamp head as recited in claim 20 further comprising a wire netting gauze attached to said protective shelter.

24. A lamp head as recited in claim 19 wherein said supporting means comprises at least two supporters downwardly extended from two facing sides of said circular wire frame for supporting said protective shelter at said predetermined height to cover said high temperature burning zone and to define said air ventilation clearance.

25. A lamp head as recited in claim 24 wherein each of said supporters comprises a U-shaped wire stand having a bottom end adapted to secure on a reflector member which is adapted for supporting said reflecting disc in position.

26. A lamp head as recited in claim 20 wherein said supporting means comprises at least two supporters downwardly extended from two facing sides of said circular wire frame for supporting said protective shelter at said predetermined height to cover said high temperature burning zone and to define said air ventilation clearance.

27. A lamp head as recited in claim 26 wherein each of said supporters comprises a U-shaped wire stand having a bottom end adapted to secure on a reflector member which is adapted for supporting said reflecting disc in position.

28. A lamp head as recited in claim 22 wherein said supporting means comprises at least two supporters downwardly extended from two facing sides of said circular wire frame for supporting said protective shelter at said predetermined height to cover said high temperature burning zone and to define said air ventilation clearance.

29. A lamp head as recited in claim 28 wherein each of said supporters comprises a U-shaped wire stand having a bottom end adapted to secure on a reflector member which is adapted for supporting said reflecting disc in position.

30. A lamp head as recited in claim 23 wherein said supporting means comprises at least two supporters downwardly extended from two facing sides of said circular wire frame for supporting said protective shelter at said predetermined height to cover said high temperature burning zone and to define said air ventilation clearance.

31. A lamp head as recited in claim 30 wherein each of said supporters comprises a U-shaped wire stand having a bottom end adapted to secure on a reflector member which is adapted for supporting said reflecting disc in position.

32. A lamp head as recited in claim 17 further comprising a heat sensor mounted on said protective shelter to detect the temperature around said protective shelter and to turn off said halogen light source when the temperature around said protective shelter exceeds a predetermined temperature.

33. A lamp head as recited in claim 18 further comprising a heat sensor mounted on said protective shelter to detect the temperature around said protective shelter and to turn off said halogen light source when the temperature around said protective shelter exceeds a predetermined temperature.

34. A lamp head as recited in claim 21 further comprising a heat sensor mounted on said protective shelter to detect the temperature around said protective shelter and to turn off said halogen light source when the temperature around said protective shelter exceeds a predetermined temperature.

* * * * *